US006739798B2

(12) United States Patent
Vandewinckel et al.

(10) Patent No.: US 6,739,798 B2
(45) Date of Patent: May 25, 2004

(54) QUICK ADJUSTMENT MECHANISM FOR BLADE PITCH OF CONCRETE POWER TROWEL

(75) Inventors: Stephen C. Vandewinckel, Livonia, NY (US); Kim Sherman, Rochester, NY (US)

(73) Assignee: Stone Construction Equipment, Inc., Honeoye, NY (US)

( * ) Notice: Subject to any disclaimer, the term of this patent is extended or adjusted under 35 U.S.C. 154(b) by 0 days.

(21) Appl. No.: 10/335,269

(22) Filed: Jan. 2, 2003

(65) Prior Publication Data

US 2003/0138294 A1 Jul. 24, 2003

Related U.S. Application Data

(63) Continuation of application No. 09/790,711, filed on Feb. 23, 2001, now abandoned.

(51) Int. Cl.[7] ..... E01C 19/22
(52) U.S. Cl. ..... 404/112; 451/353
(58) Field of Search ..... 404/112, 118; 451/353

(56) References Cited

U.S. PATENT DOCUMENTS

| | | | | | |
|---|---|---|---|---|---|
| 2,689,507 | A | * | 9/1954 | McCrery | 404/112 |
| 2,979,996 | A | * | 4/1961 | Spitler et al. | 404/112 |
| 4,232,980 | A | | 11/1980 | Tertinek et al. | 404/112 |
| 4,577,993 | A | | 3/1986 | Allen et al. | 404/112 |
| 4,629,359 | A | * | 12/1986 | Sengupta | 404/112 |
| 4,673,311 | A | | 6/1987 | Whiteman, Jr. | 404/112 |
| 5,147,146 | A | | 9/1992 | Harding, Jr. | 404/97 |
| 5,205,669 | A | * | 4/1993 | Neff | 404/112 |
| 5,372,452 | A | * | 12/1994 | Hodgson | 404/112 |
| 5,405,216 | A | | 4/1995 | Allen et al. | 404/112 |
| 5,658,089 | A | * | 8/1997 | Allen | 293/126 |
| 5,993,109 | A | | 11/1999 | Motl et al. | 404/112 |
| 6,019,433 | A | * | 2/2000 | Allen | 299/39.3 |
| 6,019,545 | A | * | 2/2000 | Allen et al. | 404/112 |
| 6,132,134 | A | * | 10/2000 | Hodgson | 192/130 |

* cited by examiner

*Primary Examiner*—Gary S. Hartmann
(74) *Attorney, Agent, or Firm*—Jacobson Holman PLLC

(57) ABSTRACT

A rotary power trowel machine for finishing concrete surfaces and more particularly to a quick adjustment mechanism for the pitch of the blades. The quick adjustment mechanism includes a control lever mounted on the operating handle of the trowel in a position to be easily grasped and operated by a trowel operator. The control lever changes the blade pitch through a mechanical advantage linkage which reduces the force applied to the control lever to adjust the blade pitch. The control lever includes a locking mechanism to lock the control handle and linkage in selected positions to lock the blades at a desired pitch angle. The locking mechanism includes a semicircular guide mounted on the trowel operating handle and extending through openings in the control lever. A locking device on the control lever lockingly engages the guide and is selectively locked and released from an upper end of the control lever.

15 Claims, 4 Drawing Sheets

QUICK ADJUSTMENT MECHANISM FOR BLADE PITCH OF CONCRETE POWER TROWEL

This is a continuation of application Ser. No. 09/790,711 filed Feb. 23, 2001 now abandoned.

BACKGROUND OF THE INVENTION

1. Field of the Invention

The present invention relates to a rotary power trowel machine for finishing concrete surfaces and more particularly to a quick adjustment mechanism for the pitch of the blades of a concrete power trowel.

2. Description of the Prior Art

Rotary power trowels have been used for many years to level and finish large concrete surfaces. Rotary power trowels include a driven rotatable trowel blade assembly having a plurality of radially extending, generally flat trowel blades which rest directly on the surface being finished. The trowel blades can be pivoted about their radial axis to change the pitch of the blades as required depending upon the characteristics of the concrete surface being finished.

U.S. Pat. No. 4,232,980 issued Nov. 11, 1980 to the assignee of the present invention discloses a rotary power trowel in which the pitch of the rotatably driven blades can be adjusted by rotating a knob or hand wheel at the upper end of an elongated control handle for the machine. Under certain circumstances, it becomes desirable to quickly change the pitch of the rotary trowel blades in order to obtain the desired finish on the concrete surface. Various efforts have been made to provide a quick adjustment of the pitch of the rotary trowel blades. The following U.S. patents illustrate various assemblies associated with the rotary trowel blades to quickly vary the pitch about their respective radial axes.

| | | |
|---|---|---|
| 4,577,993 | 5,147,146 | 5,993,109 |
| 4,673,311 | 5,405,216 | |

While the above patented devices disclose structures for rapid adjustment of the pitch of the rotary trowel blades, these prior structures do not provide a quick adjustment for the blade pitch which achieves the mechanical simplicity and ease of operability obtainable by the structure of the present invention.

SUMMARY OF THE INVENTION

The rotary power trowel of the present invention includes a unique quick adjustment for the blade pitch which enables the blade pitch to be rapidly and effectively adjusted. The unique blade pitch adjustment also quickly and easily locks the adjustment assembly in adjusted position and quickly and easily unlocks the assembly when it is desired to change the blade pitch. The quick adjustment assembly of this invention includes a control lever pivotally mounted on the shaft of the operating handle of the trowel at a position just forwardly of and between the handle bar grips on the operating handle. The control lever includes a trip handle extending upwardly from the control lever to be easily grasped by an operator holding the trowel by the handle bar grips.

The control lever is associated with a semicircular guide mounted longitudinally on the shaft of the operating handle of the trowel with the center of the semicircular guide coinciding with the pivot axis of the control lever. The trip handle is then operated to lock the control lever in any adjustment position selected around the semicircular guide. The opposite end of the control lever has an actuating rod or link pivotally connected thereto which extends forwardly into connecting engagement with one end of a pivot link also pivotally mounted on the shaft of the operating handle. The other end of the pivot link includes a partial circular segment. The cable connected at one end to the actuating mechanism for moving a swash plate associated with the rotary blades to vary their pitch angle in a well known and conventional manner has its other end wound around the partial circular segment of the pivot link.

By actuating the trip handle and pulling the control lever rearwardly (towards the handle bar grips), the connecting rod is forced forwardly (away from the handle bar grips) thus rotating the pivot link to cause the cable to move upwardly in the operating handle shaft. This upward movement of the cable depresses the actuating mechanism to move the swash plate downwardly and cause the trowel blade pitch angle to increase. When the control lever is pushed forwardly (away from the handle bar grips), the connecting rod moves rearwardly and the pivot link rotates to relax the tension on the cable. The weight of the trowel then causes the pitch angle to decrease to the extent permitted by the relaxed cable.

In one embodiment of the invention, the control lever and trip handle include a pivotal locking plate having a slot shaped opening which receives the semicircular guide. The pivotal locking plate locks the control lever to the arcuate upper and lower edges of the semicircular guide to prevent movement of the control lever. The trip handle includes a trigger mechanism that is actuated to move the locking plate out of locking engagement with the arcuate edges of the semicircular guide to enable the trip handle and lever to pivot in order to change the pitch of the blades. The trigger mechanism is preferably associated with the trip handle so that normal movement of the hand of the trowel operator into engagement with the trip handle will actuate the trigger mechanism to release the trip handle and lever from the guide when it is desired to reduce the pitch of the trowel blades by pivoting the locking plate to perpendicular relation to the guide. When the trip handle and control lever are moved in the direction to increase the blade pitch, the locking plate slot edges will move along the guide edges to permit movement of the control lever in the direction to increase the pitch and it is not necessary to operate the trigger mechanism when increasing the blade pitch with it only being necessary to pull the trip handle toward the handle bars of the control handle for the rotary power trowel.

In a second embodiment of the invention, the semicircular guide has notches on its underneath arcuate surface. The control handle and lever have a spring biased latch mechanism that engages these notches in a desired adjusted position. The latch mechanism is released by a depressable button-like projection in the upper end of the trip handle to release the lever from the guide and enable the control lever to be moved in either direction.

In both embodiments of the invention, the structural relationships of the operating components is important. The control lever handle is spaced a longer distance from the pivot point of the control lever on the operating handle shaft than the distance between the control lever pivot point and the point of connection with the connecting rod. Similarly, the distance between the point of connection of the connecting rod with the pivotal link is shorter than the radius of the circular segment of the pivot link. These differences in length to the respective pivot points of the control lever and pivot link provide a substantial mechanical advantage. This mechanical advantage enables the control lever to be pivoted in a manner to increase the pitch of the trowel blades even when all of the weight of the trowel is resting on the trowel blades. The weight of the trowel resting on the trowel blades maintains tension on the cable that connects to the swash plate actuating mechanism at all times. The mechanical advantage leverage built into the adjustment mechanism of the present invention allows the operator to increase the pitch of the blades with a minimum of effort. It also enables the operator to effectively control a decrease in the blade pitch by slowly moving the trip handle forwardly to whatever pitch angle is desired, even a zero pitch angle where the rotary blades lie flat on the concrete surface.

Accordingly, it is an object of the present invention to provide a quick adjustment mechanism for the pitch of radial blades in a rotary power trowel which can be quickly locked and unlocked to enable the pitch of the blades to be quickly adjusted.

Another object of the present invention is to provide a quick adjustment mechanism having a mechanical advantage linkage for efficient adjustment of the blade pitch and to reduce the force required to vary the pitch of the blades.

Still another object of the present invention is to provide a quick adjustment mechanism for the blade pitch of a power trowel incorporating a control lever having a trip handle oriented just forwardly of the handle bars on the operating handle of the trowel and extending above the operating handle for easy access by an operator of the trowel.

A further object of the present invention is to provide a quick adjustment mechanism in accordance with the preceding object in which the trip handle can be easily manipulated to lock and unlock the trip handle in relation to a semicircular guide rigidly affixed to and extending above the shaft of the power trowel operating handle.

A still further object of the present invention is to provide a quick adjustment mechanism for the blade pitch of a rotary power trowel in accordance with the preceding objects in which the control lever is pivoted at a central point on the operating handle of the trowel, a connecting rod is pivotally connected to the end of the control lever remote from the trip handle, the connecting rod is pivotally connected to a pivot link which is pivotally mounted on the operating handle, and a tension cable is connected to the pivot link on the side opposite the connecting rod. The tension cable extends downwardly along the operating handle to a point of connection with the swash plate actuating mechanism to vary the pitch of the blades with the mechanism of the control lever, connecting rod and pivot link providing a mechanical advantage leverage to enable the pitch of the blades to be adjusted with a minimum of force applied to the trip handle.

Yet another object of the present invention is to provide a quick adjustment mechanism as set forth in the previous objects in which the trip handle is lockingly engaged with the semicircular guide by a pivotal locking plate with a slot receiving the semicircular guide and locking the control lever and trip handle against movement by a wedging action against the arcuate upper and lower edges of the guide.

Yet a further object of the present invention is to provide a quick adjustment mechanism as set forth in the preceding objects in which the locking plate is released by a trigger mechanism incorporated into the trip handle to enable the locking plate to be unlocked with the locking plate enabling free movement of the control lever in a direction opposite to that in which the control lever becomes locked thereby enabling easy unlocking of the control lever and trip handle to enable the pitch of the blades to be reduced and enabling the pitch of the blades to be increased by moving the trip handle in an opposite direction without requiring the release of the locking plate by actuating the trigger mechanism thereby simplifying the adjustment of the blade pitch.

An additional object of the present invention is to provide a trip handle which has a latch mechanism engaging a plurality of indentations or notches on the semicircular guide with the latch being released by a trigger mechanism which releases the latch from the indentations in the semicircular guide, thus enabling the trip handle to move in either direction to decrease the pitch of the blades or increase the pitch of the blades.

A final object of the present invention to be set forth herein is to provide a quick adjustment mechanism for blade pitch of a concrete power trowel in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
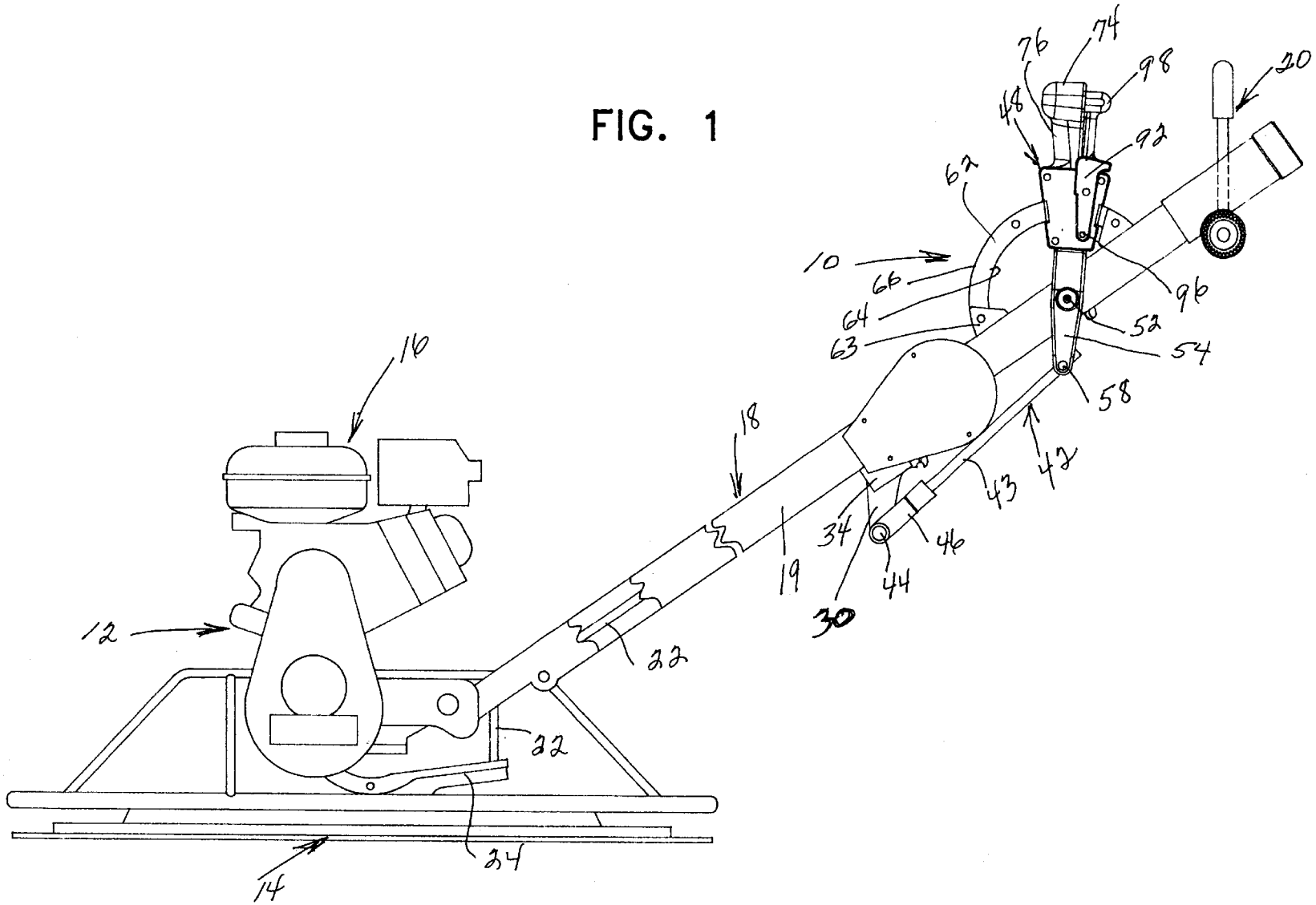
FIG. 1 is a side elevational view of a rotary power trowel having quick adjustment mechanism for the blade pitch in accordance with the present invention.

Although only two preferred embodiments of the invention are explained in detail, it is to be understood that the embodiments are given by way of illustration only. It is not intended that the invention be limited in its scope to the details of construction and arrangement of components set forth in the following description or illustrated in the drawings. Also, in describing the preferred embodiments, specific terminology will be resorted to for the sake of clarity. It is to be understood that each specific term includes all technical equivalents which operate in a similar manner to accomplish a similar purpose.

The quick adjustment mechanism of the present invention is generally indicated by reference numeral 10 and is associated with a conventional rotary power trowel generally designated by reference numeral 12. The power trowel 12 includes a rotary blade assembly generally designated by reference numeral 14 driven by a small internal combustion engine generally designated by reference numeral 16 and is provided with the usual operating handle generally designed by reference numeral 18 having a tubular shaft 19 and a handle bar assembly 20 at its upper end. Positioned in the tubular shaft 19 is a tension cable 22 which is connected at its lower end to a pivotal actuator 24. The actuator 24 engages a swash plate that controls the pitch of the blades in the blade assembly 14 by pivoting the blades about radial axes in a conventional manner.

The handle bars 20 are preferably pivoted to the upper end of the operating handle 18 for pivotal movement about a transverse axis in order to adjust the position of the handle bars in relation to the trowel to enable optimum position of the handle bars with respect to an operator. The operating handle 18 is also provided with a throttle control readily accessible to the operator of the trowel. Also, a dynamic clutch control is provided to automatically stop rotation of the blade assembly by causing the drive belt between the engine drive shaft and the gear case drive shaft to become slack, thereby stopping the blades from rotating. All of the foregoing, except for the quick adjustment mechanism 10, the details of which are described hereinafter, represent conventional structure employed in known power trowels. Hence, it is not considered necessary to describe the details of these conventional components further.

Figure 3:
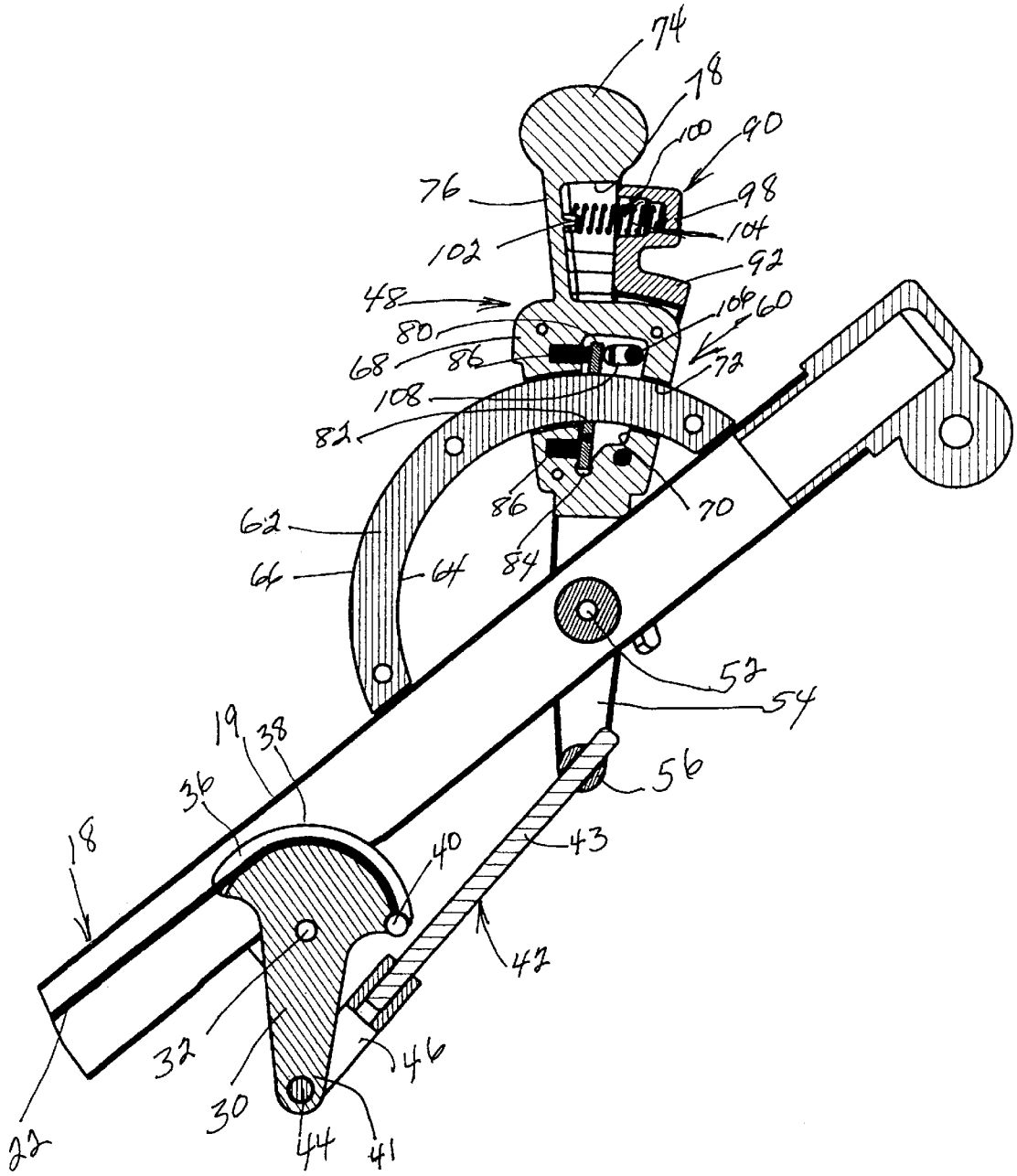
FIG. 3 is a schematic longitudinal sectional view of the quick adjustment mechanism shown in FIGS. 1 and 2 illustrating details of the control lever, trip handle, semicircular guide, locking plate and trigger mechanism.

The quick adjustment mechanism 10 of the present invention includes a pivot link 30 supported from an upper end portion of the tubular shaft 19 by a pivot pin or bolt 32 extending through depending brackets 34 as illustrated in FIG. 3. An upper end of the pivot link 30 is of arcuate configuration as indicated at 36 and provided with a peripheral groove 38. The arcuate configuration 36 is preferably a section of a circle having a defined radius. The peripheral groove 38 receives the upper end of cable 22 with the terminal end of the cable 22 being anchored to the end of the groove 38 as indicated at 40. Thus, pivotal movement of the pivot link 30 about pivot point 32 will impart linear movement to the cable 22 which is under constant tension with the lower end connected to the pivotal actuator 24 due to the weight of the power trowel resting on the trowel blades as known in the art. As the pivot link 30 pivots, the arcuate upper end thereof swings about pivot point 32 so that the point of tangency between the cable 22 and the arcuate groove 32 is always within the interior of the tubular shaft 19.

The lower end 41 of the pivot link 30 extends laterally of the tubular shaft 19 and has an elongated actuating rod generally designated by reference numeral 42 connected at its lower extremity by a pivot pin or bolt 44. The actuating rod 42 includes a connecting rod 43 and a pivotal adaptor 46 which receives one end of the connecting rod 42 and enables effective adjustable connection for the actuating rod 42 by the connecting rod 43 being threaded into the adaptor 46 or otherwise adjustably secured thereto.

In order to pivot the pivot link 30 and move the cable 22, a control lever generally designated by reference numeral 48 is pivotally mounted on the tubular shaft 19 upward of the pivot link 30 and toward handle bars 20. The lower portion of the control lever 48 is in the form of a downwardly opening yoke 50 of inverted U-shaped configuration which straddles the tubular shaft 19 and is pivotally connected to the shaft 19 at pivot point 52. The lower end of legs 54 of the yoke 50 are pivotally connected to the end of actuating rod 42 by a transversely extending pivot member 56 journalled between the ends of the legs 54 by a pivot pin or bolt 58. The end of the connecting rod 43 extends diametrically through the pivot member 56 and is adjustably connected thereto by either screw threaded engagement, set screw, clamp or the like. Thus, when the control lever 48 is pivoted about pivot point 52, the actuating rod 42 will impart pivotal movement to the link 30 for pivoting the link 30 about pivot point 32 and linear movement of the cable 22. The cable 22 is under constant tension since it, in effect supports the entire weight of the trowel, inasmuch as the trowel is completely supported by the blade assembly thus urging all of the blades in the blade assembly toward a flat engagement or zero pitch engagement with the concrete surface being finished. When the control lever 48 is pivoted forwardly toward the trowel, the lower end of the control lever 48 moves the actuating rod 42 away from the trowel and also moves the lower end of the pivot link 30 away from the trowel causing the pivot link 30 to pivot about pivot point 32 in a counterclockwise direction as seen in FIGS. 1 and 3. This counterclockwise rotation causes the cable 22 to move toward the trowel thus relaxing the cable tension. Relaxing the cable tension reduces the pressure on the actuator 24 and swash plate to decrease the pitch of the blades in the blade assembly due to the weight of the power trowel.

The control lever 48 is continuously biased toward a position in which the blades are at zero pitch due to the blades supporting the weight of the trowel. Movement of the control lever 48 toward a position to increase the pitch of the trowel blades can be accomplished by pulling the upper end of the control lever 48 toward the handle bar assembly. Thus, it is necessary to provide a locking arrangement to secure the control lever 48 in various angular positions to prevent gravity and the weight of the trowel moving the control lever to a position in which the pitch of the blades is flat or zero. A locking mechanism generally designated by reference numeral 60 is provided for the control lever 48 and includes a rigid semicircular guide 62 rigidly attached to the tubular shaft 19 at the ends thereof as by brackets 63, welding or the like. The semicircular guide 62 includes an inner edge surface 64 and an outer edge surface 66 having a center coinciding with the pivot axis 52 for the control lever 48. The transverse cross-sectional configuration of the guide 62 is rectangular and the surfaces 64 and 66 are preferably smooth, although they may be roughened as desired.

The upper end of the control lever 48 is provided with a housing 68 having a hollow interior cavity 70 and arcuate slots 72 through which the guide 62 extends. The center of curvature of the slots 72 is coincident to the pivot axis 52 for the control lever 48 thereby enabling the control lever 48 to pivot about the pivot axis 52 as the slots 72 permit the housing 68 to move along the semicircular configuration of the guide 62. The upper end of the control lever 48 includes a T-handle 74 connected to the housing 68 by connecting member 76. The connecting member 76 has a vertical cavity 78 therein which faces the handle bar assembly.

In order to lock the control lever 48 against movement in a direction to reduce the pitch of the trowel blades, the cavity 70 is provided with a locking plate 80. The locking plate 80 includes an opening in the form of a slot 82 that conforms with and receives the guide 62 in a manner similar to the slots 72 in the housing 68. The lower edge of the locking plate 80 is received and rests in a recess 84 in the lower portion of the cavity 70 in a manner that permits the locking plate 80 to pivot between a position normal or perpendicular to the edge surfaces 64 and 66 of the guide 62 and a position in angular (non-perpendicular) relation to the edge surfaces 64 and 66. The cavity 70 also includes a pair of springs 86 located above and below the slot 82 which normally bias the locking plate 80 toward the non-perpendicular position in relation to the edge surfaces 64 and 66 of the guide 62 so that the edges of the slot 82 will frictionally engage the edge surfaces 64 and 66 of the guide 62. This frictional engagement prevents the control lever 48 from pivoting in a direction toward the trowel thereby preventing the weight of the trowel to move the blade pitch to a zero angle.

However, when the control lever 48 is moved toward the handle bars, frictional engagement between the top and bottom edges of the slot 82 and the edge surfaces 64 and 66 of the guide 62 will actually compress the springs 86 to enable the locking plate 80 to move to a normal or perpendicular relation to the guide 62. This movement enables the T-handle 74 to be moved toward the handle bars 20 for tensioning the cable 22 for increasing the trowel blades to a desired pitch against the weight of the trowel. The locking plate 80 automatically locks the control lever 48 in its adjusted position when the rearward manual force has been released from the T-handle 74.

In order to release the control 48 lever for movement of the T-handle 74 toward the trowel, a trigger assembly generally designated by reference numeral 90 is incorporated into the control lever 48 along the surface thereof which faces the handle bars 20. The trigger assembly 90 includes a pivotal yoke 92 having depending legs 94 straddling the housing 68 and being pivotally connected thereto adjacent the lower ends of the legs 94 by pivot pins or pivot bolt 96. Extending upwardly from the yoke 92 is an actuating pad or button 98 which can move toward and away from the cavity 78. The inner surface of the pad 98 is hollow and receives a coil spring 100. The spring 100 has one end engaging a small projection 102 on the inner wall of the cavity 78 and the other end received in cavity 104 in the pad or button 98, as illustrated in FIG. 3. Forward pressure against pad 98 will cause the yoke 92 to pivot toward the connecting member 76 and be partially received within the cavity 78 by compressing the spring 100. The pad 98 is preferably in a position to be engaged by the thumb of an operator's hand when the hand is grippingly engaged with the T-handle 74.

When the yoke 92 is pivoted about pivot pins or bolt 96, a lock release member 106 extending between the legs 94 of the yoke 92 and received in slots 108 in the walls of the cavity 70 will engage the upper end portion of the locking plate 80 and pivot it to a position normal or perpendicular to the surfaces 64 and 66 of the guide 62 by compressing the springs 86. Movement of the locking plate 80 to its perpendicular position will release the locking engagement between the locking member 80 and the upper and lower edges of guide 62. By moving the locking plate to normal relation to the guide 62, the wedging and gripping action of the locking plate with respect to the guide 62 which occurs when the locking plate is in an angular relation to the guide (other than normal or perpendicular) will be released. This enables the control lever 48 to pivot about pivot axis 52 in a counterclockwise direction as seen in FIGS. 1 and 3.

When moved in a counterclockwise direction, the upper end of the control lever defined by the T-handle 74 moves toward the trowel and the lower end of the legs 54 move in the opposite direction toward the handle bars. Movement of the legs rearwardly also moves the lower end 41 of the pivot link 30 toward the handle bars through actuating rod 42, thereby enabling the tension cable 22 to move toward the trowel. The weight of the trowel can then pivot the trowel blades toward a lesser or zero pitch. When it is desired to change the pitch of the blades in the event of a concrete surface requiring blades having an increased pitch, it is only necessary for the operator to reach forwardly and grasp the handle 74 and pull it toward the handle bar assembly. The control lever and thus the pitch of the blades may be quickly adjusted by the operator merely reaching forward and grasping and pulling the T-handle toward the handle bars or reaching forwardly, grasping the T-handle and exerting pressure on and moving the trigger pad 98 forwardly in relation to the control lever 48 thereby releasing the control lever 48 by orientating the locking plate 80 in normal or perpendicular relation to the guide 62 thereby quickly decreasing the pitch of the blades to any degree desired by releasing pressure on the pad 98 after a desired pitch of the blades has been reached.

A mechanical leverage advantage is incorporated into the quick adjustment mechanism of the present invention by virtue of the differences in the distance between the connections of the components and the pivot point of the control lever 48 and the pivot link 30. The lever arm distance between the pivot axis 52 of the control lever 48 to the T-handle 74 is much greater than the lever arm distance between the pivot axis 52 and the pivot member 56 at the lower end of the control lever legs 54. The mechanical leverage advantage is further enhanced by the longer lever arm distance between the pivot connection 44 at the lower end of the pivot link 30 and the pivotal support pivot 32 compared with the lever arm distance (radius) between the pivot 32 for the pivot link 30 and the point of engagement between the arcuate groove 36 and the tension cable 22. This enables the operator to increase the pitch of the blades by exerting less force on the T-handle in order to move the T-handle and thus the upper end of the control lever toward the handle bar assembly. Also, by positioning the control lever 48 centrally of the operating handle 18 by utilizing the yoke structure 50 with legs 54 which straddle the shaft 19, the T-handle 74 is equally accessible to either hand of the operator of the trowel.

Likewise, the trigger mechanism is centrally located in relation to the operating handle 18 and T-handle 74. The trigger mechanism can thus be equally operated by either hand of the operator. This ergonomically advantageous arrangement of the quick adjustment mechanism provides the operator with better control of the trowel by utilizing either hand to quickly adjust the pitch of the blades while maintaining control of the trowel with the other hand. It facilitates more efficient operation of the trowel with less energy expenditure thereby enabling the operator to more efficiently finish a concrete surface.

Figure 4:
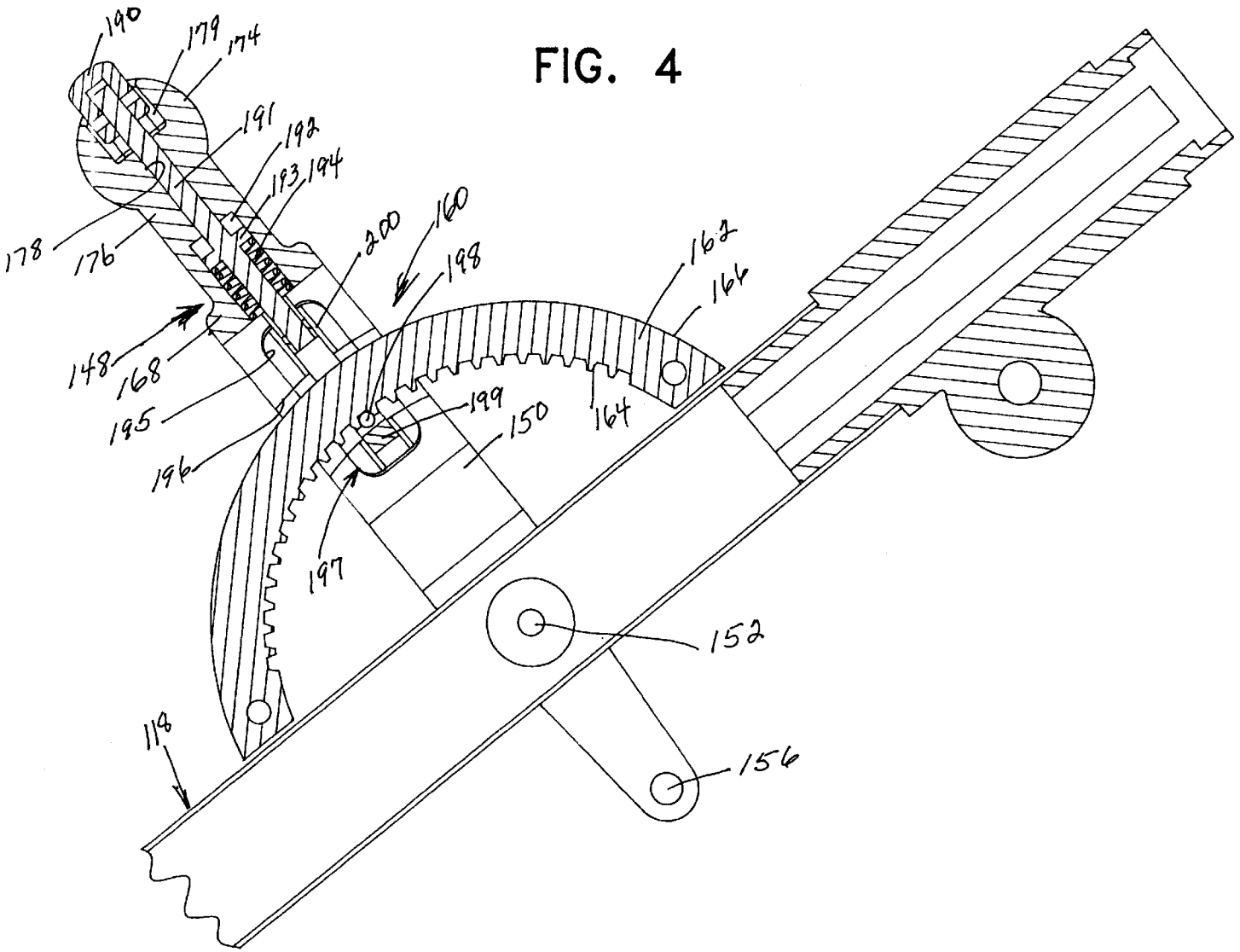
FIG. 4 is a schematic sectional view illustrating another embodiment of a quick adjustment mechanism in accordance with the present invention in which the trip handle includes a latch structure engaging notches in the semicircular guide.

FIG. 4 illustrates an alternative embodiment of the quick adjustment mechanism of the present invention. This alternative embodiment incorporates a different locking mechanism 160 including a modified control lever 148 and a modified semicircular guide 162. All of the other components and their relationships to the tubular actuating handle, tension cable, connecting rod and pivot link remain the same. The lower end of the control lever 148 is connected to a connecting rod at pivot point 156 and is connected to a pivot link in the same manner as that illustrated in FIGS. 1–3. In this embodiment of the invention, the semicircular guide 162 includes a plurality of teeth and notches 164 on the inner edge surface of the guide 162; the outer edge surface 166 of the guide is smooth.

The modified control lever 148 includes a housing 168 having a downwardly extending yoke 150 straddling the tubular shaft 118. The control lever 148 is pivotally connected to shaft 118 at pivot 152 which forms a pivot axis for the control lever 148 and also defines the center of the semicircular guide 162 which is rigidly affixed to the tubular shaft 118. The upper end of the control lever 148 includes a handle 174 which may be in the form of a partially spherical knob, a longitudinally straight cylindrical member, a T-handle or the like, which is connected to the body 168 by a connecting member 176. The connecting member 176 includes a longitudinal bore 178 which includes an enlarged upper cavity 179 opening upwardly at its upper end.

The enlarged upper cavity 179 slidably receives a longitudinally extending operating button 190 connected to an operating rod 191 which slides in the longitudinal bore 178. The portion of the connecting member 176 and the body 168 which connects with the yoke 150 is provided with a longitudinally extending middle cavity 192 slidably receiving a flange 193 on the rod 191 which is closely received within the cavity 192 for longitudinal sliding movement. A coil spring 194 is positioned around the rod 191 between the flange 193 and the lower end of the cavity 192 defined by the yoke 150. The operating rod 191 extends through the upper end of the yoke 150 and into a lower cavity 195 in the yoke which extends beyond the semicircular guide 162. The body 168 at the upper end of the yoke 150 includes arcuate slots 196 which receive the guide 162 to enable the control lever 148 to pivot about pivot axis 152.

The lower end of the rod 191 includes a locking member connected thereto generally designated by reference numeral 197. The locking member 197 includes a latch pin 198 extending transversely of the inner edge surface of the guide 162 for selective engagement with the teeth or notches 164. The latch pin 198 is connected to cross piece 199 extending between the yoke members 150 and connected to connecting members 200 which connect the longitudinal rod 191 with the transverse member 199. When the button 190 is depressed against the face of coil spring 194, the transverse member 199 is depressed and the latch pin 198 is disengaged from the teeth or notches 164 thus enabling the control lever to pivot about pivot axis 152. When the latch pin 198 is released, the control lever can be pulled towards the handle bar assembly for increasing the pitch of the blades or permitted to move forwardly toward the trowel to permit the blade pitch to decrease. This structure permits the control lever to be locked in any position in increments determined by the spacial relation of the teeth and the notches formed therebetween.

Figure 2:
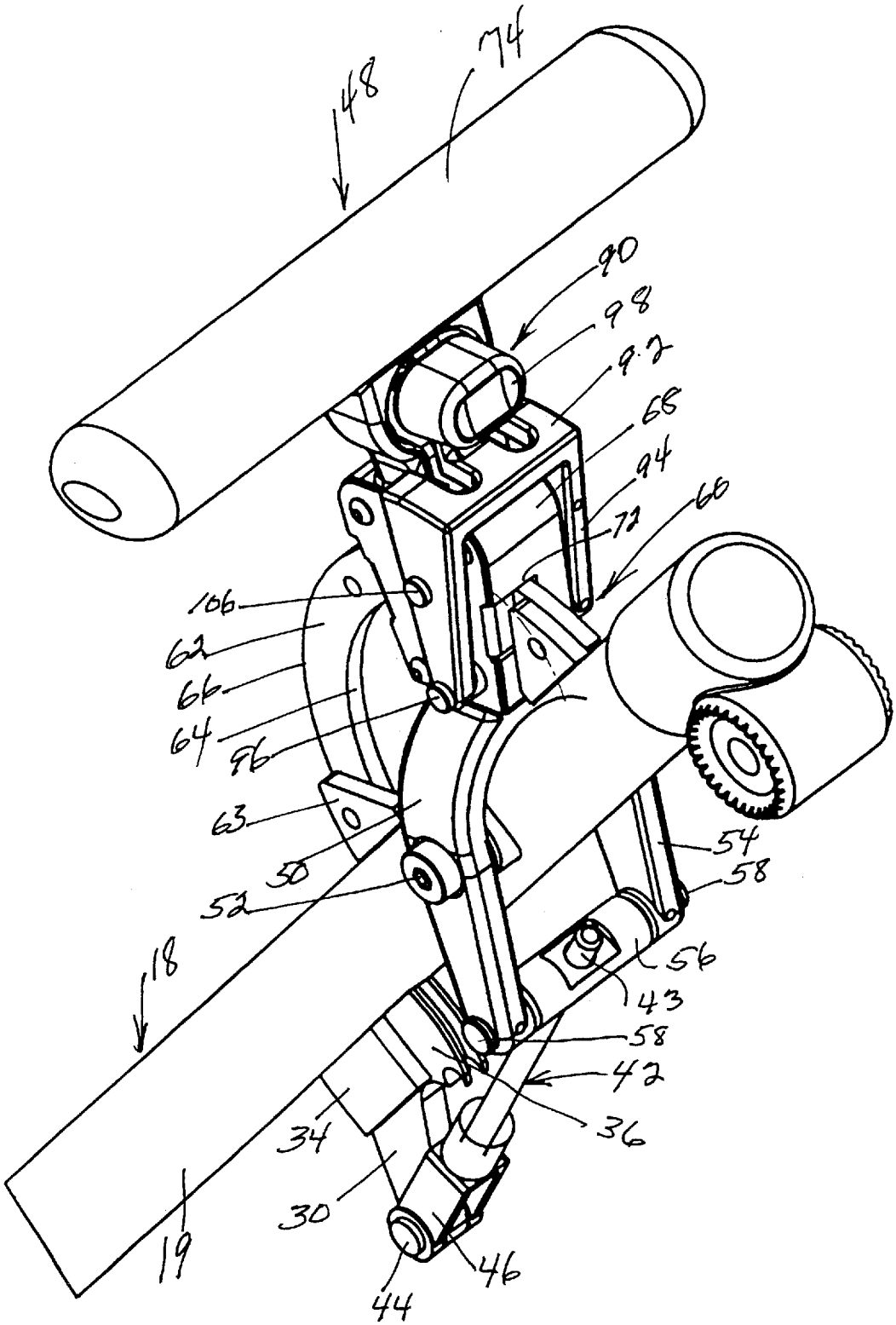
FIG. 2 is a perspective view of the quick adjustment mechanism in accordance with the present invention.

The control lever 148 incorporates the same mechanical advantage leverage as the control lever 48 in FIGS. 1–3 to enable quick adjustment of the blade pitch with less force being exerted against the handle 174 when exerting a pulling force to increase the pitch or controlling forward movement of the upper end of the control lever 148 when decreasing the pitch. The location of the release button 190 for the latch pin 198 is such that the thumb can effectively depress the button regardless of which hand of the operator is used to manipulate the control lever 148. As in the embodiment illustrated in FIGS. 1–3, the operating handle including tubular shaft 118 is provided with appropriate manual controls for the throttle setting of the engine driving the rotary trowel and a clutch for interrupting the power drive to the blades which is automatically actuated to stop the driving power to the rotary blades in the event the operator loses control of the trowel and the control handle spins in order to promptly transfer of power to the rotary trowel blades in a manner well known in the art.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A rotary power trowel including radial blades pivotally supported for pivotal movement about radial axes to vary the pitch thereof, an operating handle extending upwardly from the trowel in inclined relation to enable an operator to control movement of the trowel, a flexible tension member extending along the operating handle and operatively associated with said blades to pivot the blades to vary their pitch, and a quick adjustment mechanism varying the pitch angle of said blades, said quick adjustment mechanism comprising a control lever having a central portion pivotally supported on said operating handle, said lever including a lower end extending below the operating handle and an upper end extending above the operating handle to a position to enable an operator to grasp the upper end of the control lever with one hand to exert force thereon to pivotally move said control lever, the lower end of said control lever being connected to said tension member through a mechanical advantage linkage to facilitate pivoting the blades from a flat pitch to an angled pitch by lifting the weight of the trowel, and a locking mechanism to releasably lock said control lever in pivotal relation to the operating handle in a position to lock said blades at a pitch angle, said mechanical advantage linkage including said control lever being pivotally connected to the operating handle at a pivot point closer to a lower end of said lever than to an upper end of said lever, a connecting rod connected to the lower end of the control lever, a pivot link pivotally mounted on said operating handle, said pivot link including a lower end pivotally connected to said connecting rod and an upper end connected to said tension member, said pivotal mounting of said link on said operating handle being located closer to said upper end of said link than to said lower end of said link, said upper end of said link being arcuate and provided with a groove receiving said flexible tension member, said flexible tension member being anchored to one end of said groove and tangentially engaging said groove during pivotal movement of the link.

2. The structure as defined in claim 1, wherein the upper end of said control lever includes a control handle, a trigger mechanism mounted on an upper end portion of said control lever, said trigger mechanism being mounted on said control lever closely adjacent to and generally aligned with said control handle to enable an operator of the trowel to manipulate the control lever, control handle and trigger mechanism with either hand while maintaining control of the trowel with the other hand.

3. The structure as defined in claim 1, wherein said control handle extends transversely of an upper end of said control lever, said trigger mechanism being mounted on said control lever below said transverse control handle and aligned with a central portion of said transverse control handle, said locking mechanism including a semicircular guide fixedly mounted on said operating handle, a locking plate mounted on said control lever for movement between perpendicular and non-perpendicular relation to said guide, said locking plate including a slot like opening receiving said guide therethrough, the dimensions of said slot like opening enabling relative movement between the control lever and the guide when the locking plate is perpendicular to the guide and preventing movement of the control lever along the guide when said locking plate is in non-perpendicular relation to the guide by edge portions of the slot like opening in the locking plate engaging opposed peripheral edge surfaces of said guide to lock the control lever in at least one direction, said trigger mechanism on said control lever engaging said locking plate to move said locking plate into perpendicular relation to the guide to enable pivotal movement of the control lever in both directions.

4. The structure as defined in claim 3, wherein said locking plate and control lever include spring bias means to bias the locking plate to a locking non-perpendicular position in relation to the guide to preclude movement of the control lever in one direction of movement, said trigger mechanism including a pivotal trigger mounted on said control lever immediately below the central portion of the control handle for manual movement against the spring bias means to pivot the locking plate to a released position perpendicular to said guide and permit said spring bias means to pivot said locking plate to a locking non-perpendicular relation to said guide when said trigger is released.

5. The structure as defined in claim 1, wherein said locking mechanism includes a semicircular guide mounted fixedly on said operating handle and extending through an opening in said control lever, said guide including a plurality of teeth on an inner peripheral edge surface, said control lever including a spring biased latching pin engaged with said teeth to lock the control lever in pivotal position, said control lever including a latch pin releasing mechanism including a control button extending beyond an upper end of said control lever to enable an operator to depress the button by thumb pressure when grasping the upper end of the control lever to release the control lever from the guide to enable the lever to be pivoted in one direction to increase the pitch of the blades and permitting the weight of the trowel on the blades to move the control lever in the opposite direction to enable the blade pitch to reduce.

6. A rotary power trowel in which said trowel includes radial blades, said blades being supported for pivotal movement about radial axes to vary the pitch thereof, an operating handle extending upwardly from the trowel in inclined relation to enable an operator to control movement of the trowel, a flexible tension member extending along the operating handle and operatively associated with said blades to pivot the blades to vary their pitch, and a quick adjustment mechanism varying the pitch angle of said blades, said quick adjustment mechanism comprising a control lever having a central portion pivotally supported on said operating handle, said lever including a lower end extending below the operating handle and an upper end extending above the operating handle to a position to enable an operator to grasp the upper end of the control lever with one hand to exert force thereon to pivotally move said control lever, the lower end of said control lever being connected with said tension member, and a locking mechanism to releasably lock said control lever in relation to the operating handle in a position to lock said blades at a pitch angle, said upper end of said control lever including a T-shaped control handle at said upper end, a trigger mechanism for operating said locking mechanism, said trigger mechanism being mounted on said control lever below and in alignment with a central portion of said T-shaped handle and spaced closely below said T-shaped handle to enable an operator of the trowel to manipulate the control lever and trigger mechanism on the locking mechanism with either hand while maintaining control of the trowel with the other hand.

7. The structure as defined in claim 6, wherein said locking mechanism includes a semicircular guide mounted on said operating handle with the center of the guide coinciding with the pivot axis of the control lever, said control lever including a slot opening receiving said guide therethrough, a locking plate on said control lever including a slot opening receiving said guide therethrough, the dimensions of said slot opening enabling relative movement of the control lever along the guide when the locking plate is perpendicular to the guide and preventing movement of the control lever along the guide when the locking plate is in non-perpendicular relation to the guide by upper and lower edges of the slot opening in the locking plate engaging opposed peripheral edge surfaces of said guide to lock the control lever against pivotal movement in at least one direction, said trigger mechanism on said control lever engaging and pivoting said locking plate into perpendicular relation to the guide to enable pivotal movement of the control lever in both directions.

8. The structure as defined in claim 7, wherein said locking plate and control lever include spring bias means therebetween to bias the locking plate to a non-perpendicular locking position in relation to the guide to preclude movement of the control lever in said one direction of movement, said trigger mechanism including a pivotal member mounted on said control lever for movement between a position to pivot the locking plate to a released perpendicular position and to permit the spring bias means to pivot the locking plate to a non-perpendicular locking position.

9. The structure as defined in claim 8, wherein said control lever is connected to said tension member through a mechanical advantage linkage to facilitate change in the blade pitch by exerting a reduced force on the control lever to support the weight of the trowel when increasing and decreasing the blade pitch.

10. The structure as defined in claim 9, wherein said mechanical advantage linkage including said control lever being pivotally connected to the operating handle at a pivot point closer to said lower end of said lever than to said upper end of said lever, a connecting rod connected to said lower end of the control lever, a pivot link pivotally mounted on said operating handle, said pivot link including a lower end pivotally connected to said connecting rod and an upper end connected to said tension member, said pivotal mounting of said link on said operating handle being located closer to said upper end of said link than to said lower end of said link, said link including an arcuate upper end provided with a groove receiving said flexible tension member, said flexible tension member being anchored to one end of said groove and tangentially engaging said groove during pivotal movement of the link.

11. The structure as defined in claim 7, wherein said control lever includes a hollow housing having said slot opening therein receiving said guide, a spring between the locking plate and housing to bias the locking plate into locking position in non-perpendicular relation to the guide with edges of the slot opening in said locking plate frictionally engaging opposed peripheral edges of said guide to prevent pivotal movement of the upper end of said control lever toward said trowel blades thereby preventing the weight of the trowel moving the trowel blades toward a zero pitch angle.

12. The structure as defined in claim 11, wherein said slot opening in the locking plate includes top and bottom edges frictionally engaged with opposed peripheral edges of said guide to compress said spring when said upper end of said control lever is moved away from the trowel and enabling said locking plate to pivot to perpendicular relation to said guide for increasing the pitch angle of the trowel blades without actuating said trigger mechanism.

13. The structure as defined in claim 12, wherein said trigger mechanism includes a pivotal member mounted on said control lever and including an actuating pad facing away from said trowel, said pivotal member having a lower end engaged with said locking plate and moving said locking plate to unlocked perpendicular relation to said guide to enable the upper end of said control lever to move toward said trowel to permit said trowel blades to pivot to decrease the pitch angle of said trowel blades.

14. The structure as defined in claim 13, wherein said actuating pad is located below said upper end of said control lever, generally along a center line of said control lever and adjacent said upper end thereof to enable said actuating pad to be engaged by the thumb of either hand of a trowel operator when grasping said upper end of said control lever with either hand while controlling movement of the trowel with the other hand.

15. A rotary power trowel including radial blades pivotally supported about radial axes to vary the pitch thereof, a hollow operating handle extending upwardly from the trowel in inclined relation, a handlebar assembly mounted at an upper end of said operating handle to enable an operator to control movement of the trowel, a flexible tension member extending along the interior of said operating handle and operatively associated with said blades to pivot the blades to vary their pitch, and a quick adjustment mechanism varying the pitch angle of said blades, said quick adjustment mechanism comprising a control lever having a central portion pivotally supported on said operating handle, said lever including a lower end extending below the operating handle and an upper end extending above the operating handle to a position to enable an operator to grasp the upper end of the control lever to exert force thereto to pivotally move said control lever with one hand while controlling the trowel with the other hand engaging the handlebar assembly, the lower end of said control lever being connected to said tension member through a mechanical advantage linkage to facilitate change in the blade pitch by exerting a reduced force on the control lever to support the weight of the trowel when increasing and decreasing the blade pitch, said mechanical advantage linkage including said control lever being pivotally connected to the operating handle at a pivot point closer to said lower end of said control lever than to said upper end of said control lever, a connecting rod connected to the lower end of the control lever, a pivot link pivotally supported below said operating handle, said pivot link including a lower end pivotally connected to said connecting rod and an upper end extending into the interior of said operating handle and connected to said flexible tension member, said pivotal mounting of said link on said operating handle being located closer to said upper end of said link than to said lower end of said link, said upper end of said pivot link including an arcuate groove having a center coincident with the axis of pivotal movement of said link, said arcuate groove receiving said tension member, said tension member having an end attached to an end of said arcuate groove remote from the rotary blades and in tangential engagement with the arcuate groove during pivotal movement of said pivot link to move the tension member in the interior of the hollow operating handle.

* * * * *